US005868366A

United States Patent [19]

Tubbs, Jr.

[11] Patent Number: 5,868,366

[45] Date of Patent: Feb. 9, 1999

[54] GOLD PAN STAND

[76] Inventor: George Edward Tubbs, Jr., P.O. Box 98931, Des Moines, Wash. 98198

[21] Appl. No.: 721,466

[22] Filed: Sep. 27, 1996

[51] Int. Cl.[6] ..... A47F 5/12

[52] U.S. Cl. ..... 248/133; 248/188.9; 209/434

[58] Field of Search ..... 248/133, 131, 248/163.1, 176.1, 291.1, 188.8, 185.9; 209/434, 436, 447, 481

[56] References Cited

U.S. PATENT DOCUMENTS

| | | | |
|---|---|---|---|
| 970,385 | 9/1910 | Nash | 249/188.9 |
| 2,753,586 | 7/1956 | Metz | 248/188.9 |
| 4,200,254 | 4/1980 | Nelson | 248/188.8 |
| 5,273,165 | 12/1993 | Krenzler | 209/434 |
| 5,275,294 | 1/1994 | Krenzler | 209/434 |
| 5,447,239 | 9/1995 | Tubbs, Jr. | 209/434 |

*Primary Examiner*—Jose V. Chen
*Assistant Examiner*—Rodney B. White
*Attorney, Agent, or Firm*—David L. Tingey

[57] ABSTRACT

A traditional gold pan 10 with a flat center base 11 with a spiral sidewall guide 20 from the pan rim 13 to the pan base 11 is pivotably mounted to a stand at its top, adjustably secured in a selective tilt orientation, and continuously rotated by a drive motor.

16 Claims, 3 Drawing Sheets

GOLD PAN STAND

FIELD OF THE INVENTION

This invention relates generally to mineral washing pans and pan support stands and particularly to a stand to which a gold pan is pivotably mounted on the stand top.

BACKGROUND OF THE INVENTION

It was discovered early that particles of gold could be found in sand and gravel of stream and river beds. It was also discovered that the large difference in specific gravity between gold and sand could be used to separate the precious particles from gangue, noting that gold has a specific gravity of between 14.5 and 19.3, and sand has only a specific gravity of 2.5.

To exploit the difference in specific gravity, a gold pan now common was devised comprising a frustum, or truncated conical cylinder, with mildly inclining sides closed on its smaller end by a flat bottom. Use involves placing an amount of mineral matter in the pan with an appropriate amount of water. To separate comparatively large pebbles from the finer mineral matter, an agitation action is usually first employed that raises large matter above the fine matter. The pan is then moved in a circular motion with the pan sidewall inclined slightly below horizontal to wash away light sand material. With the water moving on the pan sidewall without excess spillage, a swirling action washes the mineral matter with the large and lighter matter being washed off of the pan.

In further washing of the matter with gentle agitation, small particles are lifted into the water to create a temporary suspension of the particles with particles of high specific gravity quickly falling back down to the pan sidewall while low specific gravity particles remain in suspension. Thus, particles are separated by specific gravity as particles of low specific gravity are suspended, carried and washed away in water. The process does not achieve a well-defined single separation but a continuum of separation, so it is necessary to repeat the process, progressively separating heavier particles from lighter particles until only the very heaviest remain.

Even the most skilled gold panner is not successful in recovering all of the gold mixed in the gangue using the traditional gold pan. Washing away low specific gravity particles also tends to wash away very small particles of high specific gravity with the sand. To improve the efficiency of the pan, various improvements have been attempted. One such improvement includes employing steps on the pan sidewall that create a pocket to capture the high specific gravity particles falling quickly out of suspension as the suspension flows laminarly over the steps. With the pan sidewal tilting slightly downwardly from horizontal, water progressively falls over succeeding steps and out of the pan carrying low specific gravity particles in suspension with it, as heavier particles fall out of suspension into the corners of the steps.

Another improvement now well-known is to have a spiral guide. wall on the pan side wall instead of concentric steps. As the pan is rotated instead of moved in a customary circular or orbital motion, small, high specific gravity particles are urged inwardly into the pan center along the guide as low specific gravity particles are washed in suspension from one spiral step to another until they fall out of the pan. High specific gravity particles that may inadvertently fall with the slurry over a guide into a more outward spiral segment are simply reprocessed as they resume their migration toward the pan center from a more distant position in the spiral.

The goal with this type of pan then is to lift the low specific gravity particles into suspension, leaving large heavy particles on the pan and washing the remainder of the slurry over the guides or steps and out of the pan.

To rotate the pan, it is normally mounted in its tilt position on a stand and rotated by a drive motor. As heavy mineral matter is separated in the pan from gangue, the pan functions more efficiently if its tilt angle is increasingly more steep. However, it is not known previous to this invetion to have a stand providing adjustment of a the pan on the stand during mineral classification to achieve a pan orientation of different tilt angles.

SUMMARY OF THE INVENTION

The object of the present invention is to reliably improve the efficiency of a gold pan with a spiral guide and its associated pan stand to efficiently recover gold not previously separated. Because the separation process is dependent on continuous mixing of the minerals so that high specific gravity particles progressively separate from lower specific gravity particles, improvement in the mixing process reaps a significant improvement in the efficiency of the panning process.

The present invention teaches a pan with a spiral guide progressing from a pan rim to a pan flat center base with a receiving cup in its center, the pan adjustable in tilt position on a pan stand.

As the size classification becomes less pronounced, a classification by specific gravity begins to control. Small heavy particles are lifted momentarily into water in the pan but the heavy matter quickly falls out of suspension back to the spiral path as large matter in the slurry immediately falls over the spiral guide. Lighter particles also remain in suspension slightly longer as the water washes these suspended particles over the guide. Light particles not washed over the guide are repeatedly subjected to this separation action at subsequent flukes until only the most dense matter remains in the spiral along the spiral rib eventually reaching the pan center planar area through this pumping and sweeping action.

The spiral guide is constructed on the pan sidewall such that when the pan is tilted in the normal manner of gold panning, the sidewall is tipped below horizontal and the guide wall is inclined above horizontal. In this manner, the slurry with gangue in suspension gravitates out of the pan as the water moves outward from spiral guide to spiral guide and then out while the particles falling out of suspension remain within the spiral guide. Then, as the pan is rotated counter to the direction of the guide, these higher specific gravity materials progress in the spiral to the pan flat base. As size classification is achieved and density classification begins to prevail, the pan becomes more efficient by increasing tilt angle. That is, during the classification process, the pan should be pivoted on its stand to a more steep, more vertical, orientation.

The result of the separation and classification on the sidewall spiral guide is that eventually only gold and black sand, which itself also contains gold, arrives at the pan base and into the cup.

To partially automate the pan process, the pan can be connected to an electric motor that continuously rotates the pan. A polygonal cylinder on the bottom of the pan base is concentric with the cup bottom protruding from the outside of the pan at its center around the cup. A motor is removably attached to the pan polygonal cylinder with a matching polygonal socket on a motor drive shaft. The motor with drive shaft and polygonal socket is typically mounted pivotably on the pan stand at the stand top to allow the pan to adjustably pivot on the stand for maximum pan efficiency in optimizing the pan vertical tilt orientation.

One skilled in the art will recognize the advantages taught by this invention and illustrated by the preferred embodiment presented. The specification and drawings are not intended to represent an exhaustive description of the invention. Obvious applications and extensions of the invention are intended to be within the spirit and scope of this invention.

DESCRIPTION OF THE PREFERRED EMBODIMENT

Figure 1:
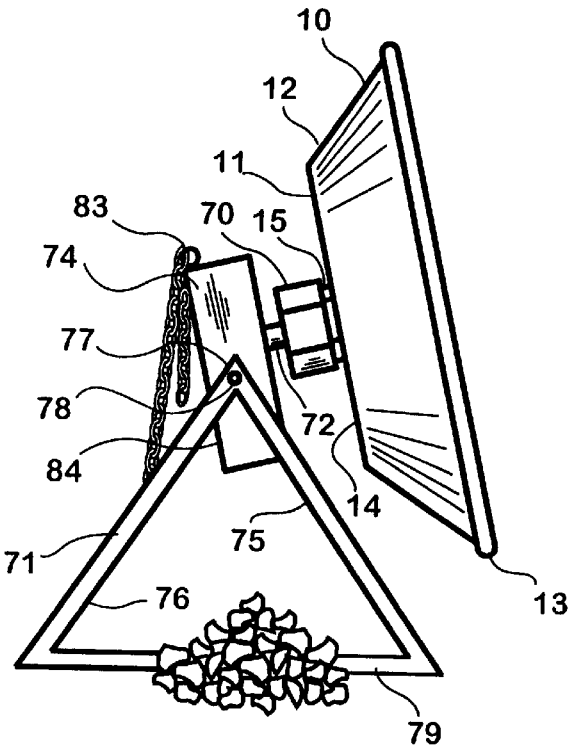
FIG. 1 is a front view of the gold pan with spiral guide and center cup.
Figure 2:
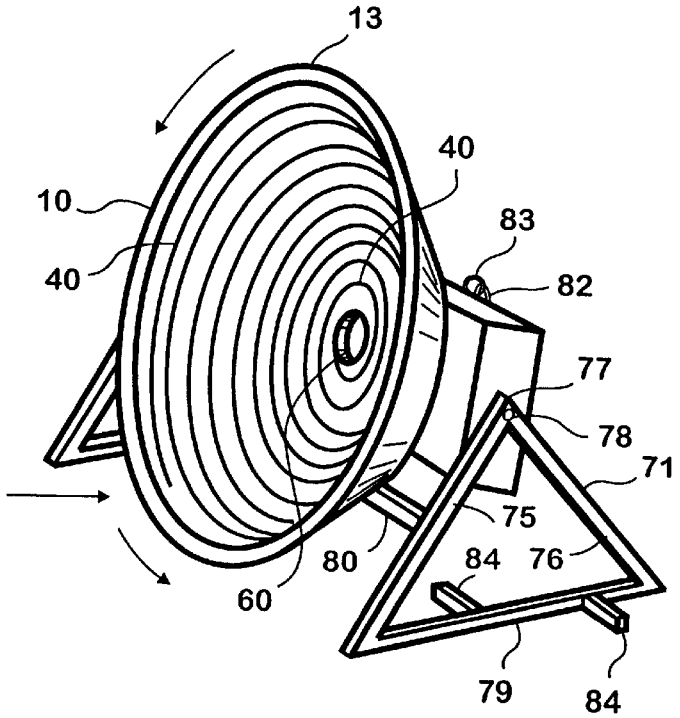
FIG. 2 pictorial view of a spiral pan pivotably mounted on a gold pan stand.
Figure 3:
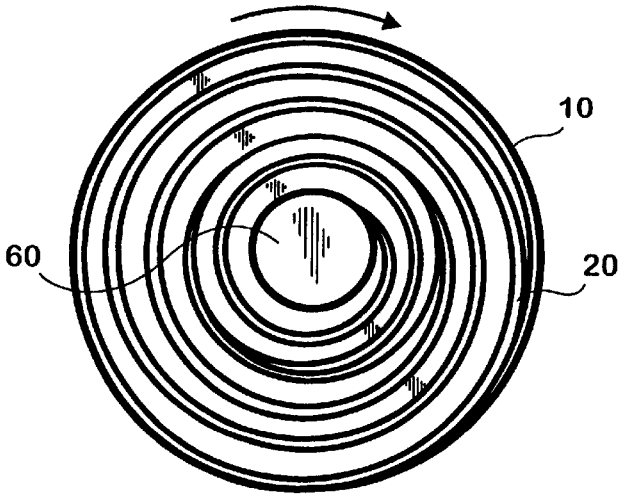
FIG. 3 is a side pictorial view of the pan in use mounted to a stand and an electrical motor.
Figure 4:
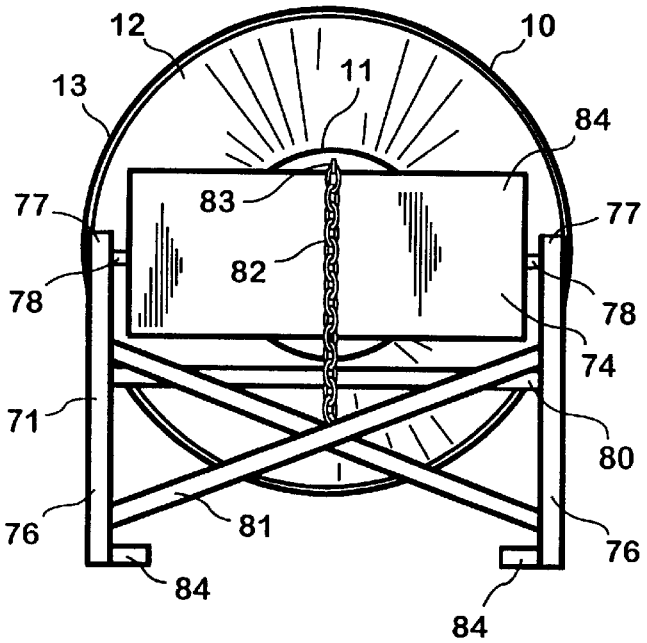
FIG. 4 is a rear view of the gold pan stand.
Figure 5:
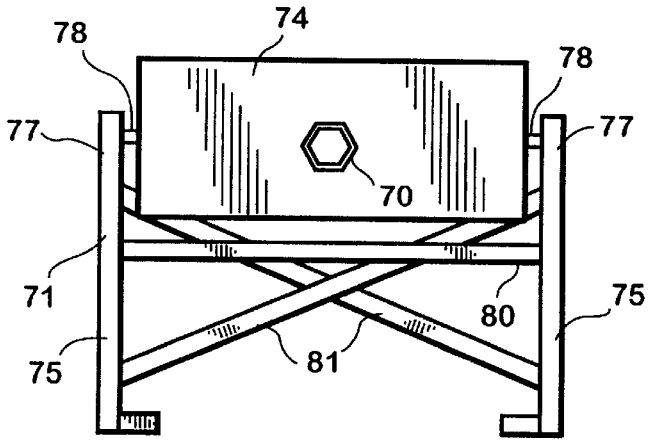
FIG. 5 is a front view of the gold pan stand.
Figure 6:
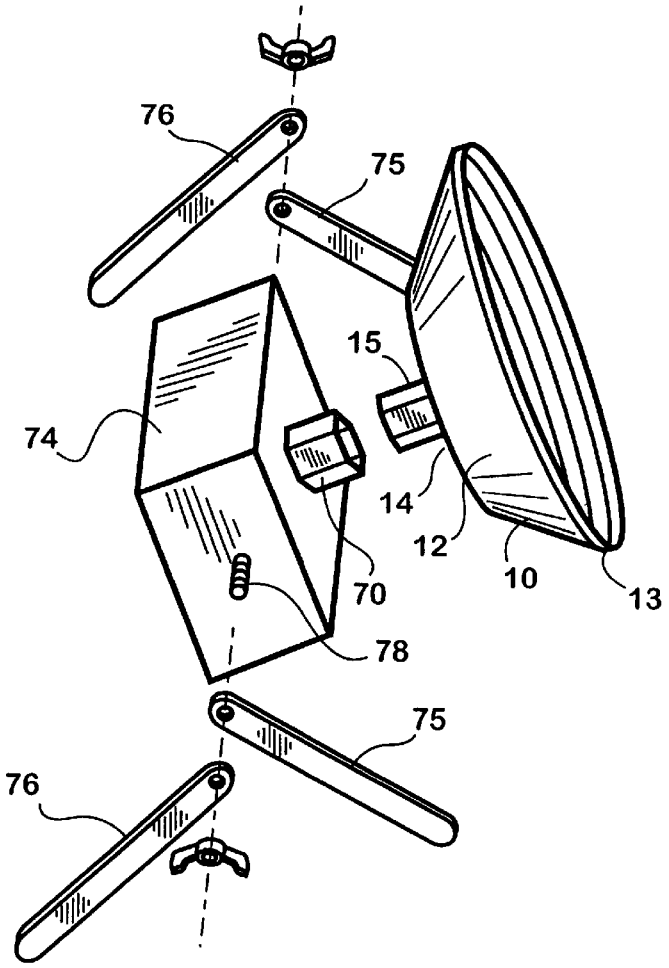
FIG. 6 is a second embodiment of the invention showing detachable legs pivotably mounted to a motor to which a pan is attached on leg ends.

Referring to the figures, the present invention is directed to a traditional frustum gold pan 10 closed with a flat base 11 at its smaller end and with a sidewall 12 inclined approximately 45° from the pan base 11 to a pan rim 13. A sidewall guide 20 progresses in a spiral from the rim 13 to the base 11, extending from the pan sidewall 12 approximately orthogonal to the pan base 11.

A spiraling base guide 40 continues from the sidewall guide 20 onto the flat base 11. A cup 60 is provided in the center of the pan base 11 at the end of the base guide 40.

From the underside of the pan 10 is a short polygonal cylinder 15 extending from the pan bottom 14 around and concentric with the base cup 60. Removably inserted around the polygonal cylinder 15 is a motor socket 70 on a motor drive 72 extending from a motor 74.

The motor 74 with drive 72 and socket 70 are pivotably mounted on a stand 71 that supports the pan 10 in an adjustable operational tilt position.

The stand 71 with identical left and right sides comprises front and back legs 75 and 76 on each side diverging from a top 77 where they join at a motor mounting shaft 78. The motor 74 is mounted pivotably on the shaft 78 extending horizontally from the stand top 77. The legs 75, 76 are secured by a leg brace 79 between the legs, preferably between the leg distal ends forming a triangular stand on each stand side with the leg brace 79 as a base disposed to engage ground therein permitting rocks and the like to be mounted over the leg brace 79 to anchor the stand, for example, in a river current. Additional front and back stand braces 80 and 81 between the right and left stand sides stabilize the stand. The pivoting motor mounted on the shaft 77 is secured in a selective tilt position by a chain 82 of adjustable length removably secured to a motor top 83 rearward and running from the motor top 83 along a motor rear 84 to a back stand brace 81. Thus, when the pan seeks under gravity bias to align itself vertically, the chain 82 taught between the back brace 81 and the motor top 83 holds the motor top 83 rearward in a tilted orientation. The amount of tilt is adjustable by changing the length of the chain 82 between the brace 81 and the motor top 83, the motor 74 pivoting at the stand top 83.

To further stabilize the stand, a stabilizing foot 84 is typically attached swivelly to at least one of the legs, adjustable in a horizontal plane.

Having described the invention, what is claimed is:

1. A gold pan stand disposed to engage a ground or a river bed and having left and right sides and a top and adapted for a traditional frustum gold pan to be mounted thereon, the pan including a flat base at its smaller end and a sidewall inclined from the pan base to a pan rim defining a concave pan front and a pan back and a sidewall guide on the pan front with an inner side and an outer side in a spiral progression around the sidewall from the rim to the base, the improvement to the stand comprising, front and back diverging legs downwardly-extending apart from each stand side, means for pivotably mounting the pan on the stand, adjustably secured in a selective lean orientation.

means for turning the pan on the stand, and

2. The stand of claim 1 in which the means for pivotably mounting the pan on the stand comprises a motor mounting shaft on each stand side extending from the stand, and a motor mounted pivotably on the shafts.

3. The stand of claim 2 in which the shafts extend from the stand top, the motor with pan attached mounted pivotably thereon.

4. The stand of claim 1 in which the legs extend downwardly from the stand top.

5. The stand of claim 4 further comprising a leg side brace between side front and back legs.

6. The stand of claim 5 in which the leg side brace extends between side front and back leg distal ends forming a triangular stand with the leg side brace as a base disposed to engage the ground and over which a mass can be piled to anchor the triangular stand to the ground.

7. The stand of claim 1 further comprising at least one back cross brace extending between stand back legs, a chain removably secured to and running along a motor back to the stand back brace where it is attached, securing the pivoting motor mounted on the shaft in a selective lean position.

8. The stand of claim 7 in which the chain is adjustable in length for adjusting lean orientation of the pan on the stand.

9. The gold pan of claim 1 wherein the means for turning the pan in the stand comprises a polygonal cylinder extending from the pan back, a motor with a motor drive pivotably mounted on the stand top, a matching polygonal socket on the motor drive into which the pan polygonal cylinder is fit.

10. A combination of a gold pan stand and a traditional frustum gold pan mounted thereon with the pan in a lean orientation, the pan including a flat base at its smaller end and a sidewall inclined from the pan base to a pan rim defining a concave pan front, the improvement comprising, a sidewall guide on the pan front in a spiral progression around the sidewall from the rim to the base, front and rear legs mounted on a stand top and diverging apart as they extend downwardly from said stand top, means for mounting the pan to the stand at the stand top.

11. The combination of claim 10 further comprising a motor with left and right sides and having a drive means, and in which a pair of said front and rear legs are attached to each of motor left and right sides, pivotably, therein providing a motor stand, pan mounting means for mounting the pan to the motor drive means.

12. The combination of claim 11 further comprising means for securing the pivotable motor on the legs in a selective lean orientation.

13. The combination of claim 11 further comprising means to secure said front and back legs in a preferred relation.

14. The combination of claim 13 in which the means for securing the diverging legs in a preferred relation comprises a leg side brace attached between diverging front and real legs.

15. The combination of claim 14 in which the leg side brace is attached between distal ends of the diverging legs triangularly.

16. The combination of claim 10 further comprising at least one stabilizing foot attached swivelly to at least one of said legs, adjustable in a horizontal plane to further stabilize the stand.

* * * * *